United States Patent [19]

Lennon

[11] Patent Number: 4,480,560

[45] Date of Patent: Nov. 6, 1984

[54] PNEUMATIC CONVEYING OF PULVERIZED SOLVENT REFINED COAL

[75] Inventor: Dennis R. Lennon, Allentown, Pa.

[73] Assignee: International Coal Refining Company, Allentown, Pa.

[21] Appl. No.: 560,015

[22] Filed: Dec. 9, 1983

[51] Int. Cl.[3] ..... F23B 7/00

[52] U.S. Cl. ..... 110/342; 110/101 R; 110/218; 110/232; 110/347; 406/197

[58] Field of Search ..... 110/101 R, 218, 232, 110/261, 262, 263, 265, 267, 297, 342, 347, 348; 406/197

[56] References Cited

U.S. PATENT DOCUMENTS

| | | | |
|---|---|---|---|
| 3,347,599 | 10/1967 | Topper et al. | 406/197 |
| 4,193,773 | 3/1980 | Staudinger | 110/101 R |
| 4,249,470 | 2/1981 | Vatsky | 110/232 |
| 4,368,678 | 1/1983 | Ulveling | 110/347 |
| 4,381,718 | 5/1983 | Carver et al. | 110/218 |

*Primary Examiner*—Edward G. Favors
*Assistant Examiner*—Steven E. Warner

[57] ABSTRACT

A method for pneumatically conveying solvent refined coal to a burner under conditions of dilute phase pneumatic flow so as to prevent saltation of the solvent refined coal in the transport line by maintaining the transport fluid velocity above approximately 95 ft/sec.

1 Claim, 1 Drawing Figure

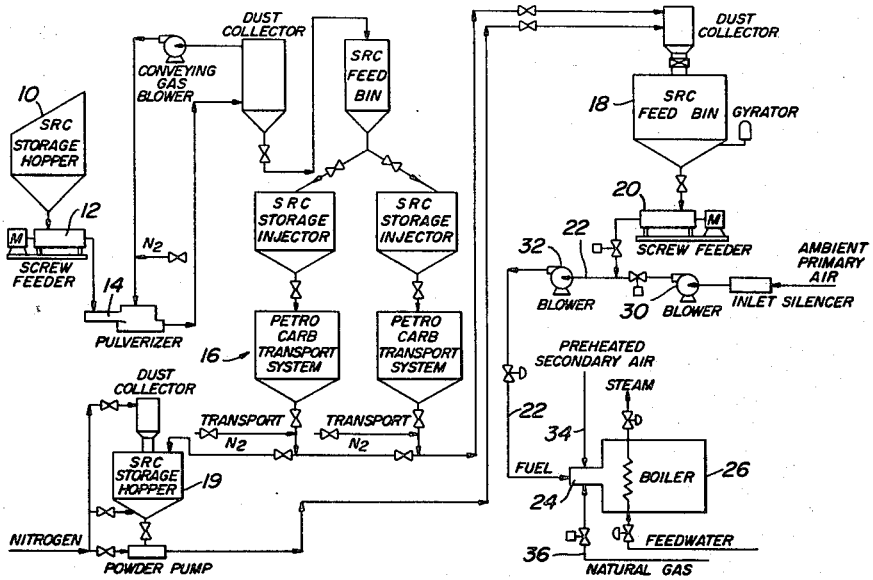

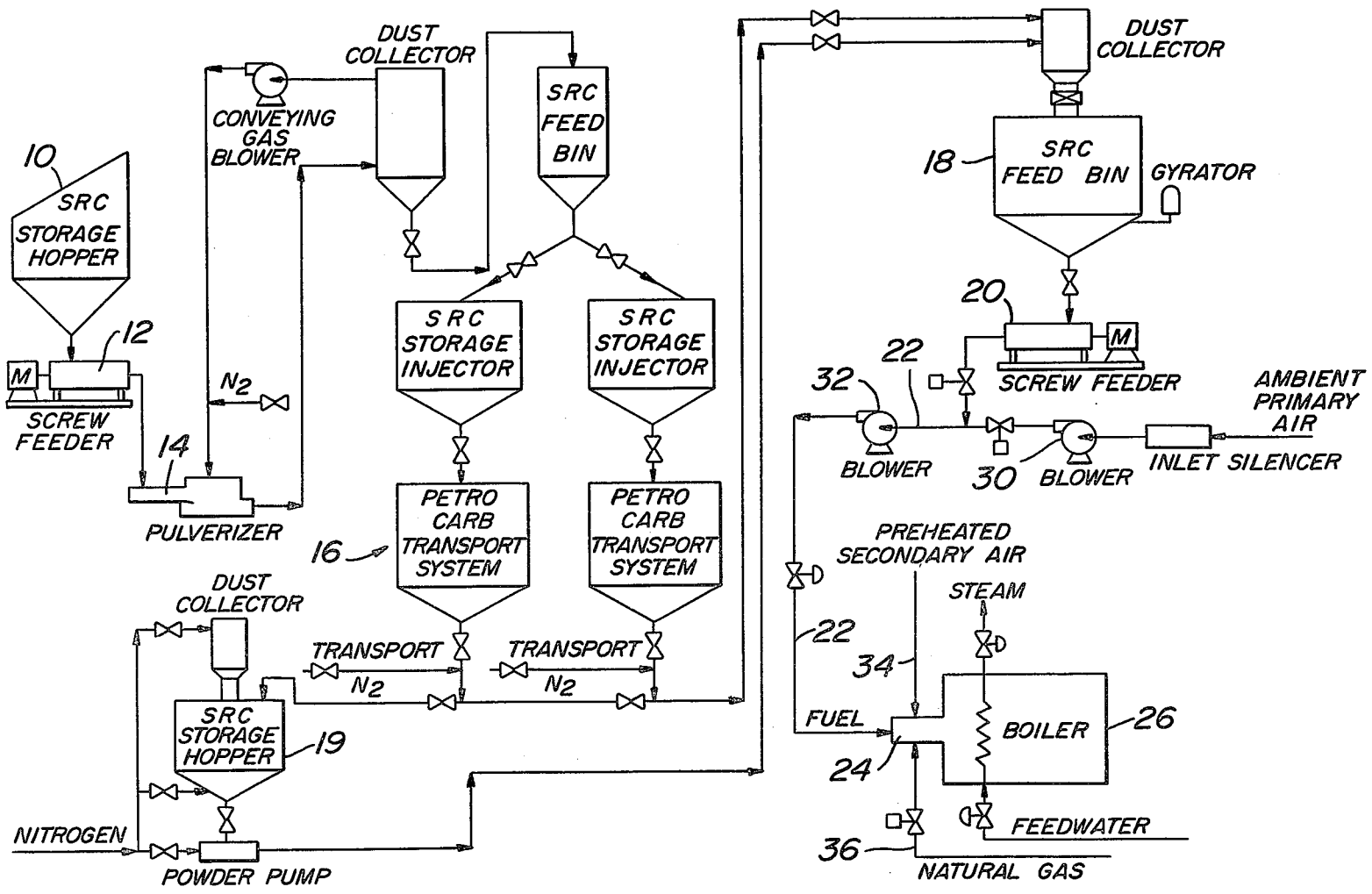
DUST COLLECTOR
SRC FEED BIN
GYRATOR
18
SCREW FEEDER
20
M
AMBIENT PRIMARY AIR
INLET SILENCER
BLOWER
30
22
BLOWER
32
PREHEATED SECONDARY AIR
STEAM
BOILER
26
FEEDWATER
NATURAL GAS
34
FUEL
24
36
22
SRC STORAGE INJECTOR
PETRO CARB TRANSPORT SYSTEM
SRC FEED BIN
SRC STORAGE INJECTOR
PETRO CARB TRANSPORT SYSTEM
TRANSPORT
N2
TRANSPORT
N2
16
DUST COLLECTOR
CONVEYING GAS BLOWER
N2
PULVERIZER
14
DUST COLLECTOR
SRC STORAGE HOPPER
19
POWDER PUMP
NITROGEN
10
SRC STORAGE HOPPER
12
SCREW FEEDER
M

PNEUMATIC CONVEYING OF PULVERIZED SOLVENT REFINED COAL

The Government of the United States of America has rights in this invention pursuant to Contract No. DE-AC05780-R03054 (as modified) awarded by the U.S. Department of Energy.

BACKGROUND OF THE INVENTION

This invention relates generally to the art of dilute phase pneumatic transfer and more particularly to the pneumatic conveying of pulverized solvent refined coal to a burner for a boiler or the like.

Solvent refined coal, also known as SRC-I, is a low sulfur, low ash, solid fuel produced from coal and having a composition such that it could be used as a utility boiler fuel which can be burned under environmentally acceptable conditions. Solvent refined coal is produced by the dissolution and hydrogenation of pulverized coal in a processderived solvent. The resulting process stream is flashed to remove hydrogen and like gases processed via critical solvent, by filtration or by other methods, to remove undissolved coal and ash, and then fractionated to separate byproduct gases and distillable liquids, recycle process solvent, and the solvent refined coal product. The solvent refined coal yield is the hydrocarbon fraction having a boiling point substantially greater than 850° F. and generally represents 40 to 70 percent of the moisture ash free feed coal.

Testing is underway by the U.S. Department of Energy to determine the suitability of solvent refined coal as a utility boiler fuel. It would be desirable if the solvent refined coal could be used in existing coal-fired units with a minimum of retrofitting and capital cost.

As to its physical characteristics, solvent refined coal typically has a sintering temperature of 170° F., a melting point of 284° F., a specific gravity of 1.24 grams per cubic centimeter and a bulk density of 50 lbs. per cubic foot as received. Also, solvent refined coal has a heating value which is considerably higher than that of coal, namely, about 15,600 Btu/lb under dry conditions. Also, solvent refined coal has a low melting point, in the range of 280°–300° F., and can become tacky at temperatures as low as 170° F. Thus, for successful pulverization, the internal mill temperature should not exceed approximately 150° F. In addition, to avoid fouling and coking of solvent refined coal on burner surfaces, cooling of the burner is recommended.

Furthermore, solvent refined coal is very friable and has a Hardgrove Value typically greater than 170 as compared to coal which normally never exceeds 100.

It has been found that, as compared to coal, the pulverizing of solvent refined coal results in the mill fineness increasing 20 to 30% in the fraction passing 200 mesh, in conjunction with a 25% drop in the mill power consumption.

In the initial testing by the U.S. Department of Energy of the firing of pulverized solvent refined coal in utility boilers, the testing equipment was designed to transport the solvent refined coal to the burner pneumatically using ambient air as the transport fluid. The assumption of the initial design was that the design parameter values for pneumatic transport systems conveying coal could be used for the designing of the transport system for the pulverized solvent refined coal. However, while this system was conservatively designed based on transporting of pulverized coal, the system exhibited unstable operation when transporting pulverized solvent refined coal.

This type of system for the transporting of pulverized solvent refined coal to a burner, as in the above-discussed testing apparatus, pertains to the well-known art of dilute phase pneumatic transfer. The principles of this art pertaining to the handling of pulverized coal and the like are set forth in the following references:

1. Frederik A. Zenz and Donald F. Othmer, "Fluidization and Fluid-Particle Systems". Library of Congress Catalog Card No. 60-10505.
2. Technical Paper, "Babcock & Wilcox's experience with two-phase flow mixtures of coal and gas", presented by A. G. Bolumen to Conference on Coal Feeding Systems, California Institute of Technology, Pasadena, Calif.—June 21–23, 1977.
3. "Pulverized-Coal Transport through Pipes", by R. D. Patterson, JOURNAL OF ENGINEERING FOR POWER, Jan., 1959.
4. STEAM, Pages 9—9 thru 9—11, "Preparation and Utilization of Pulverized Coal", published by Babcock & Wilcox Company.

It was believed that the above problem of unstable operation was due to saltation (choking) of the solvent refined coal in the transport line and subsequent reentrainment thereof. Saltation causes unsteady boiler operation, which is inefficient and hazardous. For dilute phase transport there is a minimum velocity below which the solids begin to settle in horizontal flow, this velocity being known on this art as the "saltation velocity".

SUMMARY OF THE INVENTION

It is the general object of the invention to provide a method for pneumatically conveying solvent refined coal to a burner under conditions of dilute phase pneumatic flow so as to prevent saltation of the solvent refined coal in the transport line therefor.

The object of the invention and the solution of the above-described problem was achieved in a manner contrary to expected results based on the teachings of the art as set forth in the above-listed references. Firstly, the prior art teaches (See Reference No. 4 above) that for pulverized coal the recommended transport velocity decreases as the particle size decreased or the coal fineness increases. Moreover, as is suggested in page 325 of Zenz and Othmer (Reference No. 1 above), the saltation velocity should decrease for gas-solid mixtures as the particle size decreases. Hence, the prior art teaches that if the saltation velocity for a given size particle can be determined, the saltation velocity for a smaller sized particle will be less. Moreover, the prior art teaches that if the saltation velocity for a given solids mass transfer rate can be determined, the saltation velocity for a lower solid mass transfer rate will be less. Further, the literature teaches that for powdered coal, the recommended design velocity is 65 feet per second and the saltation velocity is 14 feet per second for mixed particle sizes with an average diameter of 0.0066 inches with a particle density of 121 lb/ft$^3$ at a loading of approximately 2.3 lb/sec ft$^2$.

In accordance with the invention, the general object of the invention was achieved in a system for the pneumatic conveying of pulverized solvent refined coal to a burner under conditions of dilute phase pneumatic flow by the improvement comprising maintaining the transport fluid velocity through said transport line above approximately 95 feet per second so as to prevent saltation of the solvent refined coal in said transport line. The inventive solution to the above-described problem was achieved by maintaining a transport fluid velocity higher than that recommended for pulverized coal. This result was quite unexpected based on the teachings of the prior art.

It can be theorized that pulverized solvent refined coal has unusual surface properties which give it unexpected properties wherefore the unexpected results pursuant to the invention where achieved. These surface properties may have something to do with either stickiness, static electricity, or irregular shape. In any event, as will be described hereafter, the inventive solution to the problem has proved to be successful.

BRIEF DESCRIPTION OF THE DRAWING

The single figure of the drawing is a schematic view showing a firing system employing the pneumatic conveying of pulverized solvent refined coal from a supply thereof to burners for a utility boiler.

DETAILED DESCRIPTION OF THE PREFERRED EMBODIMENT

Referring to the Drawing, crushed solvent refined coal (SRC) is fed from a storage hopper 10 through a feeder 12 to a pulverizer 14 (such as a Mikropal ACM-10 rotating hammer mill) from which the solvent refined coal is fed to a Petrocarb pulverized fuel storage and injection system indicated at 16. The system 16 is known in the art and serves to store the SRC fuel to deliver it either to a feed bin 18 or to a reserve storage hopper 19 incorporated with a powder pump and a dense phase pneumatic transport system capable of transferring the pulverized SRC fuel to feed bin 18 as shown in the Drawing. The pulverized solvent refined coal is fed from feed bin 18 to a screw feeder 20 from which it passes into a dilute phase transport line 22 for delivering the primary air and the SRC fuel to the burner 24 for the boiler 26. In accordance with the invention the blowers 30 and 32 in the transport line 22 are operated under pressure and flow conditions such that the transport fluid velocity through the transport line 22 is maintained to be above approximately 95 feet per second so as to prevent saltation of the pulverized solvent refined coal in said transport line. At the burner 24 the primary air-coal mixture is joined with preheated secondary air supplied through a line 34 to the burner 24. Combustion takes place in accordance with conventional methods with natural gas being supplied to the burner 24 through a line 36 as shown in the Drawing.

In the operation of the system shown in the drawing, the conditions of operation relating to the pneumatic conveying of the pulverized solvent refined coal to the burner 24 is such that the conditions of dilute phase pneumatic flow of the fluid through the transport lines occurs. To this end, the primary air fan operating conditions and the particle size and concentration of the solvent refined coal supply are maintained to achieve these conditions of operation. For example, for dilute phase flow, particle sizes may range from 50% through a 200 mesh screen (0.0029 in.) to 98% through a 325 mesh screen (0.0017 in.), and particle concentrations of the order of 0 to 5 lb/ft$^3$ are normal.

Experimental data and examples supporting the invention are set forth hereafter.

The experimental work was associated with the above-mentioned contract and involved an evaluation of whether or not saltation of pulverized SRC-I out of a primary air transport line was occurring. The evaluation involved an observation as to whether or not there was occurring (1) a steady decrease in primary air flow during steady-state full load operation conditions and (2) a spike or sudden increase then a decrease returning the steam flow, carbon monoxide emission levels, and opacity levels to their former steady-state values. The steady decrease in primary air flow is considered to be an indication of the pulverized SRC-I dropping out of the conveying air stream, becoming deposited on the inner walls of the transport line, and causing an increase in pressure drop and resulting decrease in flow. The occurrence of steam flow, carbon monoxide and opacity spikes may be the result of the deposited pulverized SRC-I on the inner walls of the transport line breaking loose and becoming entrained in the fuel streams causing a sudden increase in fuel flow while a constant input of combustion air is being maintained.

Evidences of saltation were observed during initial phases of the pulverized SRC-I testing. During this time, one primary air blower, with a volumetric output of 1,500 scfm at a static pressure of 24 inches W. C. was utilized to supply the primary air. At this maximum output, while the boiler was operating at full load conditions, the blower supplied a primary air flow such that primary air velocities of about 80–90 feet per second were realized through the six inch transport line.

Due to the evidences of saltation at these velocities it was decided, pursuant to the invention and contrary to conventional teaching, to stage a second blower in series with the original primary air blower to achieve a higher primary air flow and a subsequent higher primary air velocity. As a result, a significantly higher flow of primary air was attained and during the conducting of subsequent testing, very stable combustion conditions (i.e., no severe sudden increases in steam flow, carbon monoxide emissions and opacity levels) were observed. This suggests that no saltation was taking place under these conditions. The testing conditions wherein no saltation was achieved involved primary air flows of about 96–140 feet per second.

Moreover, it was noted that range of mass loadings during the experimental testing when the evidence of saltation existed was observed to be in the range of 2.08 lbs/sec ft$^2$ which is only slightly lower than was observed by Zenz and Othmer (Reference No. 1) data collected at 2.3 lbs/sec ft$^2$. The particle size of the pulverized SRC-I used in the tests was greater than 85% through a 325 mess screen (0.0017 inches) and the tests were run at ambient air temperature.

While the above-described invention is directed to the transporting and burning of pulverized solvent refined coal, it is noted that the principles of the invention could be applicable to fuels which behave more like solvent refined coal than coal. Illustrative of such fuel could be heavy bottoms from petroleum refined vacuum towers or bottoms from coke byproduct plants such as coal derived pitch.

I claim:

1. In a system for the pneumatic conveying of pulverized solvent refined coal to a burner wherein the solvent refined coal is pulverized to a particle size in the range of 50% through a 200 mesh screen to 98% through a 325 mesh screen and conveyed in an air stream through a transport line under conditions of dilute phase pneumatic flow of the fluid through said transport line, the improvement comprising maintaining the transport fluid velocity through said transport line above approximately 95 feet per second so as to prevent saltation of the solvent refined coal in said transport line.

* * * * *